US007011558B2

(12) United States Patent
Roos

(10) Patent No.: US 7,011,558 B2
(45) Date of Patent: Mar. 14, 2006

(54) DIRECTIONALLY-STABILIZED WATERJET STEERING APPARATUS

(76) Inventor: Paul W. Roos, 711 NW. 4th Ave., Delray Beach, FL (US) 33444

( * ) Notice: Subject to any disclaimer, the term of this patent is extended or adjusted under 35 U.S.C. 154(b) by 0 days.

(21) Appl. No.: 10/947,735

(22) Filed: Sep. 23, 2004

(65) Prior Publication Data

US 2005/0064770 A1 Mar. 24, 2005

Related U.S. Application Data

(60) Provisional application No. 60/505,067, filed on Sep. 23, 2003.

(51) Int. Cl.
*B63H 21/26* (2006.01)

(52) U.S. Cl. ..... 440/62; 114/144 R

(58) Field of Classification Search ..... 114/144 R; 440/40, 43, 53, 62, 63
See application file for complete search history.

(56) References Cited

U.S. PATENT DOCUMENTS 4,334,491 A * 6/1982 Kulischenko ..... 114/144 R
4,362,515 A * 12/1982 Ginnow ..... 440/62
5,421,753 A 6/1995 Roos ..... 440/43

* cited by examiner

*Primary Examiner*—Lars A. Olson
(74) *Attorney, Agent, or Firm*—Jansson, Shupe, Munger & Antaramian, Ltd.

(57) ABSTRACT

A directionally-stabilized waterjet steering system for a marine vessel having a vessel structure and steered by an operator, comprising: a steering deflector with a center position; a tiller arm connected to the steering deflector; an input device; and a centering module connected between the tiller arm and the vessel structure, the centering module having a center detent corresponding to the center position, whereby the operator senses the center position of the steering deflector through the steering input device.

7 Claims, 2 Drawing Sheets

50
8
7
5
10
12
4
6
3
11
7
8
6
2
1
40
STEERING ACTION 5
12
3
10
11
2
1
40

DIRECTIONALLY-STABILIZED WATERJET STEERING APPARATUS

RELATED APPLICATION

This application is based on U.S. Provisional Application No. 60/505,067 filed on Sep. 23, 2003, the contents of which are incorporated herein by reference.

FIELD OF THE INVENTION

This invention relates to the field of marine propulsion, and more particularly to the improvement of the steering control of waterjet-propelled marine vessels.

BACKGROUND OF THE INVENTION

Waterjet propulsion of marine vessels has many benefits over propeller propulsion. However, a disadvantage is the lack of lateral directional stability, especially at slow speed, which is a result of not having a rudder and skegs in the water under the aft portion of the vessel. This, in combination with the natural lag in waterjet nozzle steering response, causes "fish-tailing". In propeller-driven craft, the rudder, skegs, strut and propeller cooperate to provide lateral stability and suppress excessive course deviations from a straight course. A waterjet-powered vessel must compensate by steering nozzle action to maintain a straight course.

It is possible to correct for the absence of this passive lateral stability by actively manipulating the waterjet steering nozzle to keep the vessel going in a straight line. However, it requires a much greater concentration on steering on the part of the operator than is needed for equivalent rudder-steered vessels. This takes the operator's attention away from vigilance required for safe navigation, especially at slow speed in narrow waters with high traffic volume. If this higher attention to steering is not provided, the vessel will follow a wandering or "fish-tailing" path instead of the straight line that is desired. Moreover the vessel safety is compromised if the operator can not apply full attention to navigation.

The present invention seeks to alleviate this higher attention demand for steering by assisting the operator in preventing over-steering that takes place in an effort to make the vessel progress in a straight course. The "natural" time lag mentioned above is the time between the operator's action to make a directional correction and his first observation of a directional change of the vessel which resulted from such correction. Since the response is not immediate, as with a rudder, the operator will increase the excursion of the correction (over-steer) because he sees no apparent result of his original action. The result is a major degree of overshoot from the intended course of the vessel, requiring considerable corrective action of the steering wheel in the opposite direction, resulting again in overshooting the intended course in the opposite direction. The sequence repeats itself time after time resulting in an "S" shaped or "fish-tail" course instead of a straight one.

By learning to steer the vessel in correction increments, namely by holding a steering correction for a few seconds and then returning the wheel to center before the correction gets out of hand, a major directional excursion can be prevented and the vessel can be steered in a straight line. However, such steering strategy takes a great deal of the operator's attention, especially if he cannot tell where the exact center position of the steering nozzle is. It is therefore of great importance that the operator be able to determine where the steering center position is. It is equally important for the operator to know on which side of the center position he is holding the steering wheel, if not at the center position.

A visual indicator can be used but this again requires the operator to take his attention away from navigation and look at a dial on the dashboard. Then, it will take concentration to return the wheel to the exact center position. This further defeats the purpose of maintaining the operator's attention on navigation and traffic as much as possible.

OBJECTS OF THE INVENTION

It is an object of this invention eliminate the fishtailing that is characteristic of the operation of waterjet-powered marine vessels.

Another object of this invention is to provide the operator of a marine vessel with sensory feedback sufficient to enable stable directional control.

A further object of this invention is to prevent diversion of the attention of the operator of a waterjet-powered marine vessel from the navigational task, especially at slower speeds.

Yet another object of this invention is to provide automated directional stability for waterjet-powered marine vessels.

Still another object of this invention is to provide easy selection of heading of a waterjet-powered marine vessel.

It is also an object of this invention to maintain, in waterjet-powered marine vessels, a direct linkage between the steering wheel an the water-jet steering deflector so that the operator can control the vessel at all times.

These and other objects of the invention will be apparent from the following descriptions and from the drawings.

SUMMARY OF THE INVENTION

The invention is a directionally-stabilized waterjet steering system for a marine vessel having a vessel structure and steered by an operator. The system comprises a steering deflector with a center position, a tiller arm connected to the steering deflector, an input device connected to the tiller arm, and a centering module connected between the tiller arm and the vessel structure. The centering module has a center detent corresponding to the center position. The system enables the operator to sense the center position of the steering deflector through the steering input device.

In one embodiment of the steering system, the centering module produces bias forces on the tiller arm such that the operator is able to sense which direction to move the input device in order to bring the steering deflector to the center position. In another embodiment, the steering system produces bias forces on the tiller arm that increase as the deflection of the steering deflector from the center position increases.

In a preferred embodiment, the centering module of the steering system module automatically centers the steering deflector when the operator releases the input device.

In a highly preferred embodiment of the steering system, the centering module is a first centering module having a first housing and a first connecting rod, and the system further includes: a heading sensor; a system controller; a second centering module having a second connecting rod, a second housing, and a center switch configured to indicate the center position; and a steering actuator controlled by the controller and having an actuator housing and a piston. In this embodiment, the first housing is connected to the second housing, the actuator housing is connected to the second housing, the piston is connected to the first connecting rod, the first connecting rod is connected to the tiller arm, and the second connecting rod is connected to the vessel structure. When the center switch senses the center position, the controller retrieves the current heading from the heading sensor and the controller, actuator and heading sensor cooperate to automatically maintain the current heading. The controller is programmed to release the steering actuator from automatic operation when the center switch senses a manual input to the input device.

In yet another embodiment, the system controller includes an selectable electronic heading input device.

The term "stabilize" as used herein refers to the minimizing of "fishtailing" in the steering of waterjet-powered marine vessels. The term "input device" as used herein refers to the steering wheel or other directional device such as a lever or a tiller that is used to manually input steering commands to the steering deflector of a waterjet-powered marine vessel. In this definition, the linkage between the wheel, lever or tiller and the tiller arm is included in the "input device."

BRIEF DESCRIPTION OF THE DRAWINGS

FIG. 3 also shows a linkage to an autopilot control feature of the controller.

DETAILED DESCRIPTION OF PREFERRED EMBODIMENTS

Figures 1, 2:
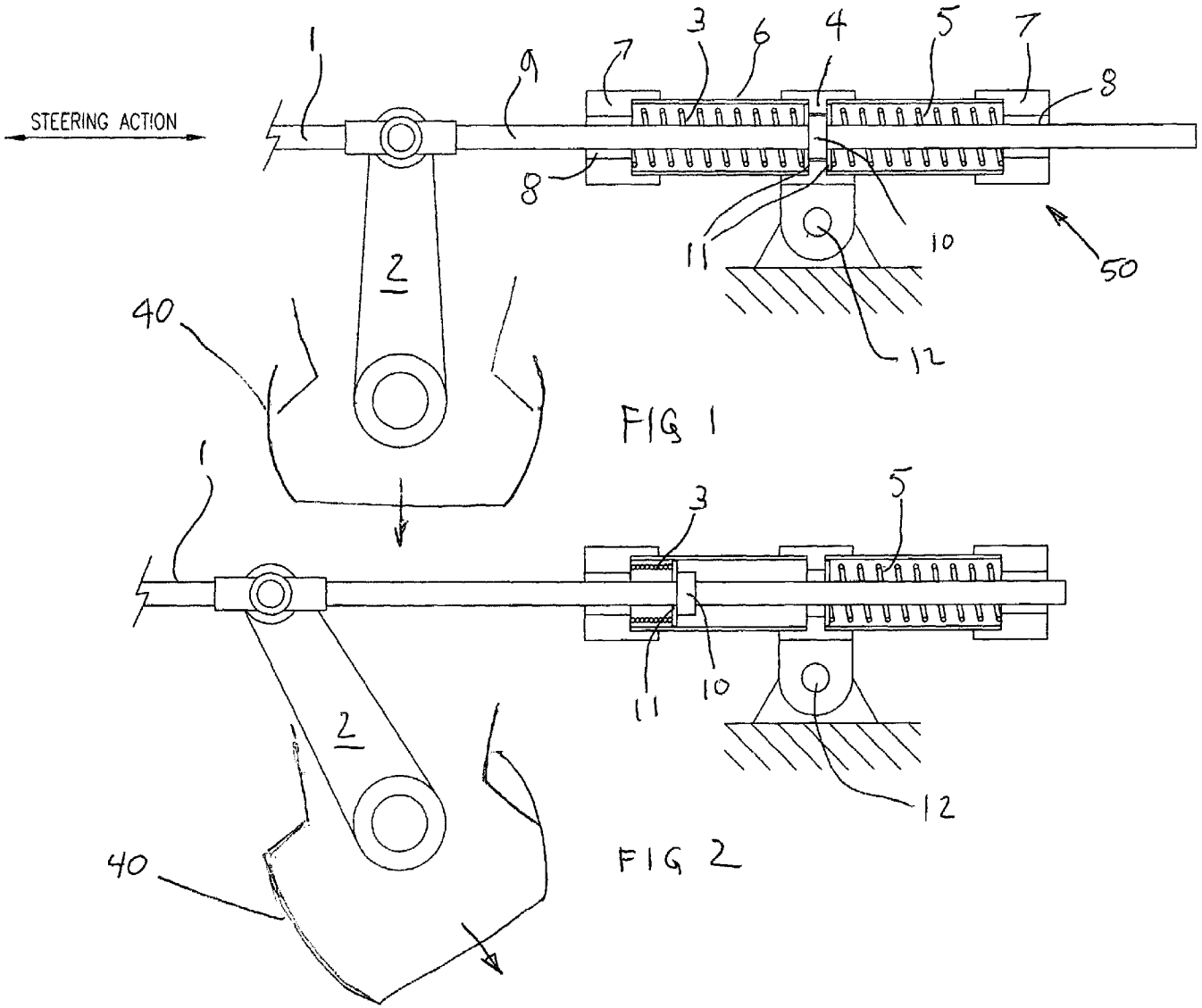
FIG. 1 is a plan view partial section showing the construction of an embodiment of a centering module for a directionally-stabilized waterjet steering system.
FIG. 2 is a plan view partial section showing the construction of the centering module of FIG. 1 with the tiller arm at a hard-over position.
Figure 3:
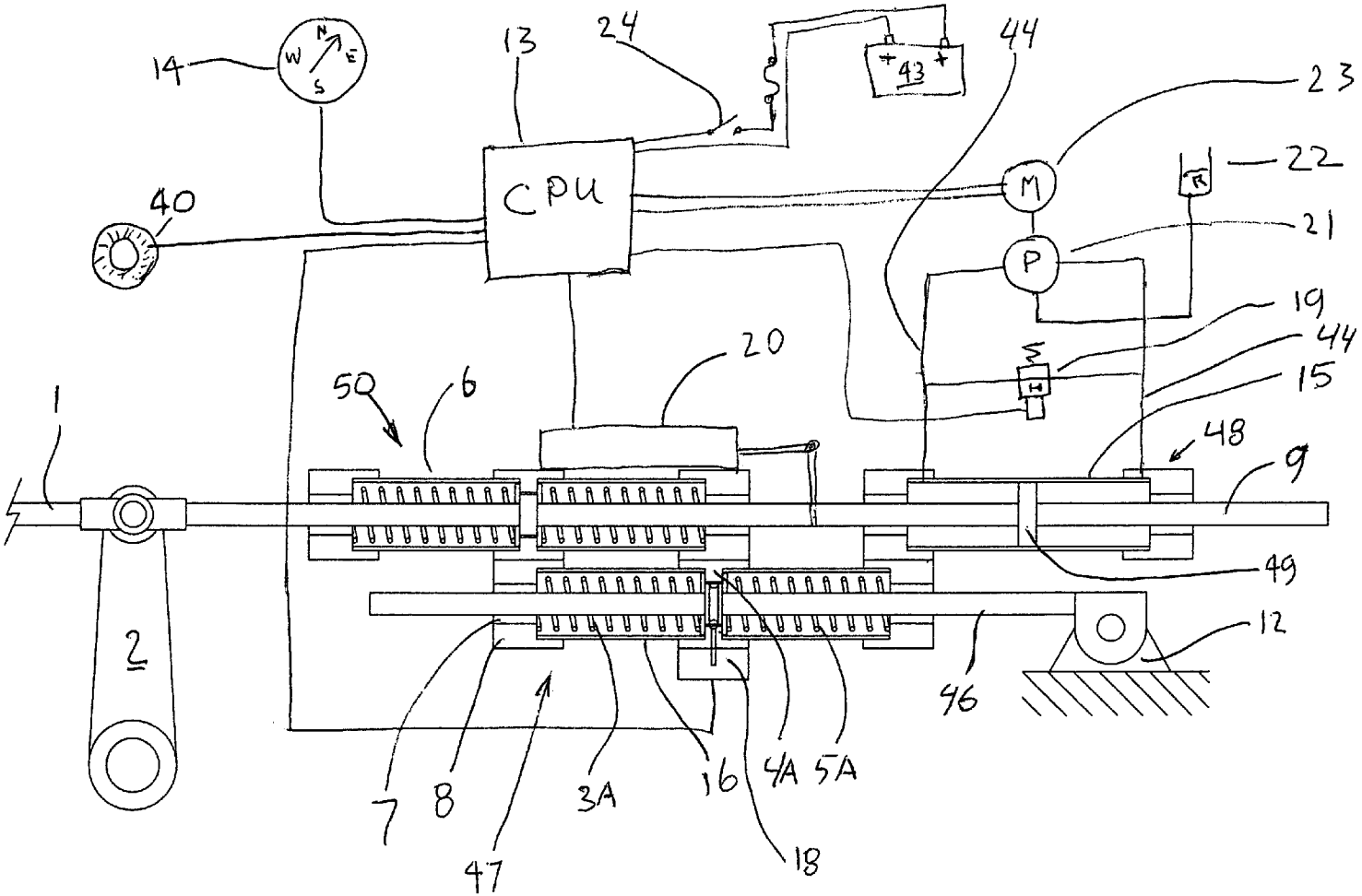
FIG. 3 is a plan view partial section of the automated directionally-stabilized waterjet steering system with first and second centering modules in cooperation.

FIG. 1 is a plan view partial section showing the construction of an embodiment of a centering module for a directionally-stabilized waterjet steering system. A centering module 50 is connected to a tiller arm 2 by means of a connecting rod 9. Tiller arm 2 drives a waterjet steering deflector 60 which effects the steering of the vessel in the water. Steering deflector 60 can be a steerable nozzle as shown in FIG. 1–3, a jet deflector plate or any other mechanism provides a movable thrust vector to steer the waterjet-powered vessel.

Tiller arm 2 is also connected to the input device 1. Input device 1 can be a cable and pulley system, a push-pull or push-push mechanical system, or a hydraulic system with feedback lock-out disabled. It remains directly connected to tiller arm 2 and can always override the passive steering assist system. Centering module 50 includes two pre-loaded springs 3 and 5 and a detent 4 in a cylinder-type housing 6 with two end caps 7 and two connecting rod bearings 8 that support connecting rod 9. Housing 6 is pivotally anchored to the vessel structure 12. The detent 4 consists of a cam 10 and washers 11. Movement of the connecting rod 9 lifts and compresses spring 3 or spring 5 depending on which direction tiller arm 2 is moved by input device 1. Because springs 3 and 5 are pre-compressed, movement of connecting rod 9 in either direction results in the compression of springs 3 or 5.

FIG. 2 shows spring 3 compressed and tiller arm 2 in a hard-over position while spring 5 remains at the pre-set length. Spring 3 biases the required turning force of input device 1, whereby movement (turning) in the direction of the spring force toward the center will be easier than turning the steering mechanism away from the center position of tiller arm. The easier direction is toward the center, indicating the same to the helmsman. Once the center is reached, spring 3 and washer 11 bottom out on detent 4, and the helmsman knows he has reached the center position.

A second centering module and an actuator and control system can be added to the system of FIG. 1 to add automated operation to the system. FIG. 3 illustrates such an automated system. Referring to FIG. 3, a first centering module 50 is connected to tiller arm 2 through connecting rod 9. Connecting rod 9 extends through housing 6 of centering module 50 and is fixed to a piston 49 within an actuator housing 15 of an actuator 48. Both actuator 48 and first centering module 50, through housing 6 and 15 respectively, are connected to a housing 16 of a second centering module 47. Second centering module 47 has a connecting rod 46 attached to vessel structure 12, thereby completing the connection relationship between tiller arm 2 and vessel structure 12.

Actuator 48 is a hydraulic cylinder operated by a hydraulic pump 21 with reservoir 22 and driven by an electric motor 23. A bypass solenoid valve 19 operates as a normally-open valve across two feedlines 44 and 45 of actuator 48. In such normally-open position, valve 19 decouples actuator 48 from first centering module 50, thereby providing failsafe manual operation of first centering module 50. When valve 19 is energized to its closed position, actuator 48 is then configured to actuate tiller arm 2 through connecting rod 9. All of these hydraulic system elements are well-known to those skilled in the art of hydraulic systems.

Motor 23 is controlled by controller 13 connected to a heading sensor 14 and powered by battery 43 through power switch 24. Controller 13 is shown as a CPU (central processing unit) of a micro-computer nut could be any other programmable control device capable of simple servo control functions. Heading sensor 14 is a solid-state compass but could also be any other compass or inertial heading device configured to provide a electronic heading signal to controller 13. A position sensor 20 provides indication of the position of connecting 9 as a feedback signal to controller 13 during automatic operation.

In automatic mode (when power switch 24 is closed), controller 13 closes valve 19, thereby coupling actuator 48 into the steering system. When entering automatic mode, controller 13 retrieves a current heading and sets this heading value as the controlled heading of the system. Second centering module 47 is held in its center position defined by a detent 4A by two springs 3A and 5A in the same fashion as the operation of first centering module 50. During automatic operation, second centering module 47 remains in detent 4A, providing a force-transmitting path between vessel structure 12 and tiller arm 2 to enable controller 13 to hold the marine vessel on the controlled heading.

Second centering module 47 has a center switch 18 which indicates to controller 13 when second centering module 47 is in detent 4A. When input device 1 is moved by an operator to override the automatic mode, second centering module 47 is moved out of detent 4A, thereby changing the state of center switch 18. Controller 13 is programmed to de-energize valve 19 when it receives such an indication from switch 18. This action decouples actuator 48 from first centering module 50 and puts the steering system back into manual mode.

When the operator releases input device 1, tiller arm 2 is driven to its center position by the centering action both first and second centering modules 50 and 47. When center switch 18 senses that second centering module 47 is in detent 4A once again, controller 13 receives such indication from switch 18, retrieves a new current heading from heading sensor 14, sets this new current heading as new controlled heading value, and re-energizes valve 19 to return the system to automatic mode with such new controlled heading value.

When in automatic mode, the controlled heading value can be changed by the operator electronically, without the decoupling action of the manual override process described above. Referring again to FIG. 3, a selectable electronic heading input device 40 is connected to controller 13 to provide such a signal. Selectable electronic heading input device 40 can be a potentiometer, linear or angular encoder, or other similar input device well-known to those skilled in the art of electronic control systems.

While the principles of this invention have been described in connection with specific embodiments, it should be understood clearly that these descriptions are made only by way of example and are not intended to limit the scope of the invention.

What is claimed is:

1. In a marine vessel having a vessel structure, a waterjet, and a waterjet steering system steerable by an operator, the steering system having a steering deflector with a center position, a tiller arm connected to the steering deflector, and an input device connected to the tiller arm, the improvement comprising a centering module connected between the tiller arm and the vessel structure and having a center detent corresponding to the center position, whereby the operator senses the center position of the steering deflector through the input device.

2. The steering system of claim 1 wherein the centering module produces bias forces on the tiller arm such that the operator is able to sense which direction to move the input device in order to bring the steering deflector to the center position.

3. The steering system of claim 2 wherein the bias forces on the tiller arm increase as the deflection of the steering deflector from the center position increases.

4. The steering system of claim 2 wherein the centering module automatically centers the steering deflector when the operator releases the input device.

5. The steering system of claim 2 wherein the centering module is a first centering module having a first housing and a first connecting rod, and the system further includes:

a heading sensor;

a system controller;

a second centering module having a second connecting rod, a second housing, and a center switch configured to indicate the center position; and a steering actuator controlled by the controller and having an actuator housing and a piston, wherein:

the first housing is connected to the second housing;

the actuator housing is connected to the second housing;

the piston is connected to the first connecting rod;

the first connecting rod is connected to the tiller arm; and the second connecting rod is connected to the vessel structure, such that when the center switch senses the center position, the controller retrieves the current heading from the heading sensor and the controller, actuator and heading sensor cooperate to automatically maintain the current heading.

6. The steering system of claim 5 wherein the controller is programmed to release the steering actuator from automatic operation when the center switch senses a manual input to the input device.

7. The steering system of claim 5 wherein the system controller includes a selectable electronic heading input device.

* * * * *